US008440382B2

(12) United States Patent
Isono et al.

(10) Patent No.: US 8,440,382 B2
(45) Date of Patent: May 14, 2013

(54) METHOD OF PRODUCING TONER

(75) Inventors: Naoya Isono, Suntou-gun (JP); Katsuyuki Nonaka, Mishima (JP); Yasuhiro Hashimoto, Mishima (JP); Akira Sugiyama, Yokohama (JP); Yuhei Terui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 186 days.

(21) Appl. No.: 13/153,324

(22) Filed: Jun. 3, 2011

(65) Prior Publication Data

US 2011/0305989 A1 Dec. 15, 2011

(30) Foreign Application Priority Data

Jun. 15, 2010 (JP) ..... 2010-135807

(51) Int. Cl.
*G03G 9/087* (2006.01)

(52) U.S. Cl.
USPC ..... 430/137.14; 430/137.1

(58) Field of Classification Search ..... 430/137.14, 430/137.1
See application file for complete search history.

(56) References Cited

U.S. PATENT DOCUMENTS

| | | | | |
|---|---|---|---|---|
| 5,601,913 | A | 2/1997 | Ohtani et al. | |
| 6,458,502 | B1 | 10/2002 | Nakamura et al. | |
| 6,569,589 | B2 | 5/2003 | Inaba et al. | |
| 7,014,969 | B2 | 3/2006 | Yachi et al. | |
| 7,112,393 | B2 | 9/2006 | Komoto et al. | |
| 7,459,253 | B2 | 12/2008 | Abe et al. | |
| 7,704,661 | B2 | 4/2010 | Ikeda et al. | |
| 7,887,983 | B2 | 2/2011 | Sata et al. | |
| 2006/0051693 | A1* | 3/2006 | Sata et al. | 430/109.4 |
| 2007/0141495 | A1* | 6/2007 | Sweeney | 430/108.2 |
| 2007/0212628 | A1* | 9/2007 | Ishikawa | 430/105 |
| 2007/0219313 | A1* | 9/2007 | Mizuhata et al. | 524/599 |
| 2007/0259283 | A1 | 11/2007 | Abe et al. | |
| 2009/0035688 | A1 | 2/2009 | Abe et al. | |
| 2009/0130582 | A1 | 5/2009 | Handa et al. | |
| 2011/0053073 | A1 | 3/2011 | Isono et al. | |
| 2011/0097660 | A1 | 4/2011 | Sugiyama et al. | |
| 2011/0136054 | A1 | 6/2011 | Watanabe et al. | |

FOREIGN PATENT DOCUMENTS

| | | | |
|---|---|---|---|
| CN | 1183581 | A | 6/1998 |
| CN | 1746777 | A | 3/2006 |
| JP | 03132668 | A * | 6/1991 |
| JP | 2007-41503 | A | 2/2007 |
| JP | 2008-145950 | A | 6/2008 |

OTHER PUBLICATIONS

Machine English language translation of JP 96012479 B2, Feb. 1996.*

Chinese Office Action dated Aug. 20, 2012 in Chinese Application No. 201110164753.2.

* cited by examiner

*Primary Examiner* — Hoa V Le
(74) *Attorney, Agent, or Firm* — Fitzpatrick, Cella, Harper & Scinto

(57) ABSTRACT

A method of stably producing a toner is provided. This method provides a long-term stabilization of material dispersion in a colorant-dispersed solution and inhibits segregation of the material and provides a more microfine and more uniform dispersion of the colorant in the toner, and moreover produces a toner that has a sharp toner particle diameter distribution. This method of producing toner has at least a colorant dispersion step of obtaining a colorant-dispersed solution by dispersing a pigment-containing colorant in a liquid mixture that contains the colorant and a dissolved resin solution or a polymerizable monomer, wherein the liquid mixture contains a nonionic surfactant and the nonionic surfactant has at least an oxyalkylene group and has a hydrophile-lipophile balance value (HLB value) of 9.0 or more and 17.0 or less.

6 Claims, No Drawings

METHOD OF PRODUCING TONER

BACKGROUND OF THE INVENTION

1. Field of the Invention

The present invention relates to a method of producing toner that is used to visualize the electrostatic latent image in image-forming methods such as electrophotographic methods, electrostatic recording methods, magnetic recording methods, and toner jet methods.

2. Description of the Related Art

The technology of visualizing image information through an electrostatic latent image, as in, for example, electrophotographic methods, is in wide use in a variety of fields, e.g., copiers, printers, and so forth. The fields of application have also broadened as technology has developed, and electrophotographic equipment has thus become quite diverse and there has been demand for various types of additional value, such as a higher image quality and improvements in the durability and fixing performance.

Against this background, segregated-functionality structures have in recent years become the favorite for the toners used in electrophotographic methods (devices), while the main stream in toner production has become wets, which can relatively easily provide additional value. Various systems have been investigated for wet toners by the individual companies, and production methods such as suspension polymerization methods, emulsion polymerization methods, and solution suspension methods have been suggested according to a function of the material composed in the toner and the desired toner particle morphology.

For example, in the suspension polymerization methods and solution suspension methods, a colorant-dispersed solution that constitutes the toner is granulated in a liquid dispersion medium using a high-speed stirrer to obtain liquid droplets that have a desired particle diameter. A toner particles-dispersed solution is then obtained, in suspension polymerization methods by carrying out a polymerization step and in solution suspension methods by removing the solvent. This is followed by separation of a cake of damp toner particles from the toner particles-dispersed solution and acquisition of the toner particles by pulverizing and drying. Classification is then performed as necessary and prescribed additives are added to produce the toner. A production method of this type facilitates the generation of a high durability in combination with a high developing performance and can provide a toner that has a segregated-functionality core-shell structure.

A toner with an improved fixing performance and an improved transfer performance, achieved by a more detailed engineering of the core-shell structure and specifying the microcompression hardness of the toner, has been disclosed (for example, Japanese Patent Application Laid-open No. 2008-145950).

A method has also been disclosed that makes possible a low-temperature fixability and an enhanced gloss without a loss of durability; this is achieved by controlling the molecular weight distribution of the core by the addition of a low-molecular weight component (for example, Japanese Patent Application Laid-open No. 2007-41503).

These methods make it possible to impart a desired functionality to toner and have resulted in very substantial improvements in performance. On the other hand, in order to provide electrophotographic devices that meet the growing demands imposed by the marketplace, it has become necessary to design toner in conformity to individual devices, which has made the production of multiple product types unavoidable. Due to this, a stability capable of withstanding even the long-term standing caused by product change over has also come to be required of the above-mentioned colorant-dispersed solution.

However, the conventional production methods have certain problems with regard to the long-term stability of the colorant-dispersed solution, and a problem here has been the occurrence to a greater or lesser degree of segregation of the material in the colorant-dispersed solution during long-term standing. Due to this, at the present time the problem arises that toner particles produced after long-term standing of the colorant-dispersed solution mixture exhibit a distorted or disturbed particle diameter distribution, which results in the problem of an inferior durability and developing performance.

In addition, the production process necessary to execute the segregated functionality mentioned above is more complex than in the past, and quiescence or stasis in the individual production steps can occur. In view of these circumstances, it is again a very important problem to bring about a stable colorant-dispersed solution mixture through an excellent state of dispersion.

The stable production of a plurality of toner product types is also still a problem to be addressed, and the appearance of a technology that provides a high degree of dispersion stabilization for colorant-dispersed solution mixtures is strongly desired.

SUMMARY OF THE INVENTION

The present invention provides a method of producing toner that solves the problems identified above for the background technology. That is, the present invention provides a method of stably producing a toner wherein the method provides for a long-term stabilization of the colorant dispersion in the colorant-dispersed solution and inhibits colorant segregation.

The present invention also provides a method of stably producing a toner wherein the method is at least as efficient as conventional methods, the colorant is more uniformly and more microfinely dispersed in the toner, and the toner provides an excellent developing performance and a stable image density.

The present invention further provides a method of stably producing a toner that has a sharp particle diameter distribution.

As a result of intensive investigations in order to solve the problems identified above, the inventors found that a toner that provides the performance required by these problems is obtained by the method described below. The present invention was achieved as a consequence.

That is, the present invention relates to a method of producing toner, this method including at least a colorant dispersion step of obtaining a colorant-dispersed solution by dispersing a pigment-containing colorant in a liquid mixture that contains this colorant and a dissolved resin solution or a polymerizable monomer, wherein the liquid mixture contains a nonionic surfactant and the nonionic surfactant has at least an oxyalkylene group and has a hydrophile-lipophile balance value (HLB value) of 9.0 or more and 17.0 or less.

The present invention makes it possible to inhibit the sedimentation and aggregation of the colorant in the colorant-dispersed solution that would occur during long-term standing and to make the dispersion of the colorant in the toner more uniform. In addition, even when production is carried out after long-term standing, the increased uniformity of the starting material in the colorant-dispersed solution makes possible the production of toner particles that have a sharp particle diameter distribution. Moreover, toner particles that have an excellent durability, ageing resistance, and developing performance can be stably produced.

Further features of the present invention will become apparent from the following description of exemplary embodiments with reference to the attached drawings.

DESCRIPTION OF THE EMBODIMENTS

The method of producing toner of the present invention (also referred to below simply as the producing method of the present invention) is a method of producing toner, the method of producing toner comprising at least a colorant dispersion step of obtaining a colorant-dispersed solution by dispersing a pigment-containing colorant in a liquid mixture that contains the colorant and a dissolved resin solution or a polymerizable monomer, wherein the liquid mixture contains a nonionic surfactant and the nonionic surfactant has at least an oxyalkylene group and has a hydrophile-lipophile balance value (HLB value) of 9.0 or more and 17.0 or less.

For a liquid mixture that contains a pigment-containing colorant and a dissolved resin solution or a polymerizable monomer, the aggregation and/or sedimentation of the colorant in the dissolved resin solution or polymerizable monomer, i.e., in the aforementioned colorant-dispersed solution, can be inhibited—even during long-term standing—by dispersing the colorant in this liquid mixture in the presence of a nonionic surfactant that has the above-indicated properties. As a consequence, even when toner production is carried out using this colorant-dispersed solution after the colorant-dispersed solution has been subjected to long-term standing, a toner that exhibits an excellent durability and developing performance can still be stably produced.

The details of the mechanism underlying the present invention are unclear, but the present inventors propose the following. The nonionic surfactant that is required by the present invention has an oxyalkylene group, which adsorbs to polar regions scattered on the surface of the pigment. It is thought that this inhibits re-aggregation and prevents sedimentation and separation of the pigment. In addition, the HLB value, which indicates the hydrophile-lipophile balance for the nonionic surfactant, is also important. The specific range mentioned-above is essential for the pigment to maintain a stable state of dispersion in the oil layer, i.e., the dissolved resin solution or polymerizable monomer.

When the HLB value is less than 9.0, the lipophilic group in the nonionic surfactant has a strong influence, which impedes adsorption to the pigment surface and thus works against the appearance of the effects of the present invention. When, on the other hand, the HLB value is larger than 17.0, the hydrophilicity presented by the nonionic surfactant exercises an overly strong influence; as a result, emulsified particles are produced during granulation and image defects are then prone to appear, e.g., development stripes and fogging due to contamination of the development member. Viewed from the perspective of achieving the effects of the present invention more consistently, a more preferred range for this HLB value is 10.0 or more and 16.0 or less and an even more preferred range is 10.5 or more and 15.0 or less.

Nonionic surfactants generally refer to materials falling into the nonionic-type surfactant classification of the Miscellaneous Manufactured Goods Quality Labeling Regulations from the Ministry of Economy, Trade, and Industry of Japan.

The nonionic surfactant used by the present invention is a nonionic surfactant that has an oxyalkylene group and that has an HLB value that satisfies the above-indicated range, but is not otherwise particularly limited. However, a nonionic surfactant classified as a polyalkylene glycol type is preferred. Polyalkylene glycol-type surfactants can be exemplified by higher alcohol alkylene oxide adducts, alkylphenol alkylene oxide adducts, fatty acid alkylene oxide adducts, and alkylene oxide adducts on the esters of polyhydric alcohols with fatty acids. Particularly preferred thereamong are higher alcohol alkylene oxide adducts and fatty acid alkylene oxide adducts.

Here, the oxyalkylene and alkylene oxide are preferably ethylene oxide or propylene oxide or both ethylene oxide and propylene oxide. The average number of moles of addition for this alkylene oxide is preferably 3 or more and 20 or less and more preferably is 5 or more and 15 or less.

The higher alcohol in the higher alcohol alkylene oxide adduct preferably has 4 or more and 34 or less of carbons and more preferably has 8 or more and 30 or less of carbons.

The fatty acid in the fatty acid alkylene oxide adduct preferably has 4 or more and 34 or less of carbons and more preferably has 8 or more and 30 or less of carbons.

The alkyl in the alkylphenol alkylene oxide adduct preferably has 5 or more and 20 or less of carbons and more preferably has 8 or more and 15 or less of carbons.

In the case of the alkylene oxide adducts on the esters of polyhydric alcohols with fatty acids, the fatty acid therein preferably has 8 or more and 34 or less of carbons and more preferably has 12 or more and 30 or less of carbons. The polyhydric alcohol is preferably sorbitol or erythritol.

The nonionic surfactant used by the present invention must contain an oxyalkylene group and more preferably contains both an oxyethylene group and an oxypropylene group as the oxyalkylene group. The hydrophilic moiety that is the polar moiety of the oxyethylene group and the lipophilic moiety of the oxypropylene group bring about a synergetic effect that improves the dispersibility of the colorant in the dissolved resin solution or polymerizable monomer and facilitates the generation of a high tinting strength.

The ratio to the number of moles of oxyethylene group (EO) addition to the number of moles of oxypropylene group (PO) addition in the aforementioned oxyalkylene group, or EO:PO, is preferably 50:1 to 1:1 and more preferably is 20:1 to 2:1.

The nonionic surfactant content in the liquid mixture under consideration is preferably 0.03 mass part or more and 0.50 mass part or less per 100 mass parts of the polymerizable monomer or resin present in the dissolved resin solution. The effects of the present invention are fully obtained when the content is in this range. In addition, the increase in the hygroscopicity of the toner particles due to the presence of the nonionic surfactant can be inhibited when this range is satisfied. A more preferred range for this content is 0.05 mass part or more and 0.40 mass part or less.

The nonionic surfactant specified for the present invention may also be a mixture of two or more nonionic surfactants. In this case, it is preferable that the total amount of the nonionic surfactant specified by the present invention satisfies the content range given above.

The producing method of the present invention comprises a colorant dispersion step of obtaining a colorant-dispersed solution by dispersing a pigment-containing colorant in a liquid mixture that contains the colorant and a dissolved resin solution or a polymerizable monomer, and there is no particular limitation on the other steps in this producing method. Methods of producing toner that include the indicated colorant dispersion step can be exemplified by suspension polymerization methods using a polymerizable monomer and solution suspension methods using a dissolved resin solution.

This dissolved resin solution denotes a uniform mixture provided by the dissolution of a resin in a solvent.

As described above, the present invention is characterized by a colorant dispersion step in which a nonionic surfactant that has an oxyalkylene group and a HLB value of 9.0 or more and 17.0 or less, is introduced into a liquid mixture comprising a pigment-containing colorant and a dissolved resin solution or polymerizable monomer and a colorant-dispersed solution is obtained by dispersing the colorant in the presence of this nonionic surfactant.

A known dispersing device can be used in the colorant dispersion step to disperse the colorant. Examples in the case of media dispersion methods are a CoBall Mill from Shinko-Pantec Co., Ltd (today's Kobelco Pantech Co., Ltd.), a Dyno-Mill from Shinmaru Enterprises Corporation, an Apex Mill from Kotobuki Industries Co., Ltd., a continuous attritor from Mitsui Mining Co., Ltd. (today's Nippon Coke & Engineering Co., Ltd), a Handy Mill from Mitsui Mining Co., Ltd., an SC mill from Mitsui Mining Co., Ltd., and a Star Mill LMZ and Star Mill ZRS from Ashizawa Finetech Ltd. Examples in the case of high-shear dispersion methods are a FILMICS from Tokushu Kika Kogyo Co., Ltd. (today's PRIMIX Corporation), SS5 from M Technique Co., Ltd., Cavitron from Pacific Machinery & Engineering Co., Ltd., Ebara Milder from the Ebara Corporation, and DRS-2 and DRS-2000 from IKA. Examples in the case of high-pressure dispersion methods are the Altimizer from Sugino Machine Limited and the Nanomaker and Nanomizer from Nanomizer Inc. However, there is no limitation to the preceding.

In addition, processing a mixture of the liquid medium and colorant by the serial incorporation in the same circulation line of dispersing devices that employ different dispersing methodologies is preferred because this provides a better dispersed state than processing by a single dispersion methodologies or processing in a batch regime using a plurality of dispersion methodologies.

The method of producing toner is described in the following using the example of the suspension polymerization method, which is most favorably used for the producing method of the present invention.

The colorant-dispersed solution may be produced in the present invention as follows: using a dispersing device as described above, a primary dispersion of the pigment-containing colorant in the polymerizable monomer is prepared; as necessary, a release agent, charge control agent, polymerization initiator, other additives, and any remaining polymerizable monomer when only a portion of the polymerizable monomer was used to prepare the primary dispersion, are subsequently added and a liquid mixture is prepared; and the pigment-containing colorant is then uniformly dispersed in this liquid mixture by using, for example, an homogenizer, an ultrasound disperser, and so forth. With regard to the timing of nonionic surfactant addition, the nonionic surfactant may be added when the primary dispersion of the pigment-containing colorant is performed or when the pigment-containing colorant is dispersed in the liquid mixture. Addition during execution of the primary dispersion of the colorant is preferred in order to obtain additional improvements in the long-term stability of the colorant-dispersed solution. In addition, while the timing of nonionic surfactant addition has been described for the case of toner production by the suspension polymerization method, it is the same for the case of toner production by the solution suspension method, and in fact any timing may be used for nonionic surfactant addition.

The colorant-dispersed solution produced in the preceding colorant dispersion step is then suspended, using an ordinary stirring device or a Clearmix, a homomixer, an homogenizer, and so forth, in an aqueous medium that contains a dispersion stabilizer and is granulated (granulating step) to provide a desired toner particle size. The particle diameter of the particles can be adjusted in this granulating step by adjusting the stirring speed and time.

The granulating step is followed by a polymerization step in which the polymerizable monomer is polymerized in the aqueous medium. Known conditions may be employed for the polymerization conditions in this polymerization step, and polymerization is favorably performed by setting the temperature to 40° C. or more and generally to 50° C. or more and 90° C. or less. In addition, the temperature may be raised in the latter half of the polymerization reaction and, in order to remove, for example, by-products and unreacted polymerizable monomer that can cause odor during toner fixing, a portion of the aqueous medium may be distilled out in the latter half of the reaction or after completion of the reaction. After the polymerization step, the toner particles are obtained by washing, filtration, and drying.

As necessary, the particle diameter distribution of the obtained toner particles may be adjusted by a classification step. The toner is obtained, as necessary, by the addition of external additives comprised of, for example, inorganic fine particles, organic fine particles, and so forth.

A preferable polymerizable monomer suitable for use in the suspension polymerization method described above is radically polymerizable vinylic polymerizable monomer. A monofunctional polymerizable monomer or a polyfunctional polymerizable monomer can be used as this vinylic polymerizable monomer.

The monofunctional polymerizable monomer can be exemplified by styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; vinyl esters such as methylene aliphatic monocarboxylic acid esters, vinyl acetate, vinyl propionate, vinyl butyrate, vinyl benzoate, and vinyl formate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

The polyfunctional polymerizable monomer can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, divinyl ether, and 4,4'-divinylbiphenyl.

A single such monofunctional polymerizable monomer or a combination of two or more may be used, or a combination of the aforementioned monofunctional polymerizable monomer and a polyfunctional polymerizable monomer may be used, or a single polyfunctional polymerizable monomer or a combination of two or more may be used. Among the above-described monomers, the use of styrene or a styrene derivative, either singly or as a mixture thereof or the use of styrene or a styrene derivative mixed with a monomer other than styrene or a styrene derivative, is preferred from the standpoint of the durability and developing characteristics of the toner.

Various crosslinking agents can also be used in those instances in which polymerization of a polymerizable monomer is performed. In addition to the above-described polyfunctional polymerizable monomers, the crosslinking agent can be exemplified by polyfunctional compounds such as glycidyl acrylate, glycidyl methacrylate, and so forth.

In the case of a polymerization method that uses an aqueous medium, such as the suspension polymerization method, a polar resin is preferably added to the above-described liquid mixture. The addition of a polar resin can promote the encapsulation of the release agent.

When a polar resin is present in the colorant-dispersed solution suspended in the aqueous medium, the polar resin, due to differences in the affinity for water, readily migrates into the neighborhood of the interface between the aqueous medium and the colorant-dispersed solution and as a consequence the polar resin segregates to the surface of the toner particle. As a result, the toner particle has a core-shell structure and the release agent assumes an excellent encapsulation behavior even at high release agent contents.

In addition, when a polar resin having a high melting temperature is selected for the polar resin used for the shell, the appearance of problems such as blocking during storage can be inhibited—even in those instances in which having the binder resin melt at a lower temperature has been pursued with the goal of low-temperature fixing.

The aforementioned polyester resin can be a polyester resin provided by the polycondensation of an acid component monomer as described below with an alcohol component monomer as described below.

The acid component monomer can be exemplified by terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexanedicarboxylic acid, trimellitic acid, and so forth.

The alcohol component monomer can be exemplified by alkylene glycols such as ethylene glycol, diethylene glycol, triethylene glycol, 1,2-propylene glycol, 1,3-propylene glycol, 1,4-butanediol, neopentyl glycol, and 1,4-bis(hydroxymethyl)cyclohexane, and also by polyalkylene glycols, bisphenol A, hydrogenated bisphenol, ethylene oxide adducts on bisphenol A, propylene oxide adducts on bisphenol A, glycerol, trimethylolpropane, and pentaerythritol.

The polar resin content is preferably 1.00 mass part or more and 20.00 mass parts or less per 100 mass parts of the polymerizable monomer and more preferably is 2.00 mass parts or more and 10.00 mass parts or less per 100 mass parts of the polymerizable monomer.

Viewed in terms of the blocking resistance, multisheet durability, low-temperature fixability, and offset resistance of the toner, a wax that is a solid at room temperature is favorably used as the optionally added release agent. Examples are hydrocarbon waxes such as paraffin waxes, polyolefin waxes, microcrystalline waxes, and Fischer-Tropsch waxes, as well as polymethylene waxes, amide waxes, higher fatty acids, long-chain alcohols, and ester waxes and derivatives of the preceding such as graft compounds and block compounds. Waxes are preferred from which the low-molecular weight components have been removed to provide a sharp highest endothermic peak in the endothermic curve obtained by a differential scanning calorimeter.

The use is preferred among the preceding of a wax having a melting point, as indicated by the highest endothermic peak obtained by a differential scanning calorimeter, of 60° C. or more. This melting point is the value of the peak temperature of the endothermic main peak in the DSC curve in the temperature range from 30° C. to 200° C. during the second temperature rising process in a normal temperature/normal humidity environment (25° C./60%) using a measurement temperature range of 30° C. to 200° C. and a rate of temperature rise of 10° C./minute. The measurement can be performed using, for example, a model MDSC-2920 differential scanning calorimeter (DSC) from TA Instruments.

This wax preferably has a penetration, as measured at 25° C. based on the test method specified in JIS K 2235 (1991), of 10 or less from the standpoint of the ease of dispersion.

The release agent content is preferably 1 mass part or more and 50 mass parts or less per 100 mass parts of the polymerizable monomer or binder resin and more preferably is 4 mass parts or more and 40 mass parts or less per 100 mass parts of the polymerizable monomer or binder resin.

The colorant used in the present invention must contain a pigment, and may be used in combination with a pigment and/or in combination with a dye. Examples here are the following organic pigments, organic dyes, and inorganic pigments.

Organic pigments and organic dyes that are cyan colorants can be exemplified by copper phthalocyanine compounds and their derivatives, anthraquinone compounds, and basic dye lake compounds. The following are specific examples: C. I. Pigment Blue 1, C. I. Pigment Blue 7, C. I. Pigment Blue 15, C. I. Pigment Blue 15:1, C. I. Pigment Blue 15:2, C. I. Pigment Blue 15:3, C. I. Pigment Blue 15:4, C. I. Pigment Blue 60, C. I. Pigment Blue 62, and C. I. Pigment Blue.

Organic pigments and organic dyes that are magenta colorants can be exemplified by condensed azo compounds, diketopyrrolopyrrole compounds, anthraquinones, quinacridone compounds, basic dye lake compounds, naphthol compounds, benzimidazolone compounds, thioindigo compounds, and perylene compounds. The following are specific examples: C. I. Pigment Red 2, C. I. Pigment Red 3, C. I. Pigment Red 5, C. I. Pigment Red 6, C. I. Pigment Red 7, C. I. Pigment Violet 19, C. I. Pigment Red 23, C. I. Pigment Red 48:2, C. I. Pigment Red 48:3, C. I. Pigment Red 48:4, C. I. Pigment Red 57:1, C. I. Pigment Red 81:1, C. I. Pigment Red 122, C. I. Pigment Red 144, C. I. Pigment Red 146, C. I. Pigment Red 150, C. I. Pigment Red 166, C. I. Pigment Red 169, C. I. Pigment Red 177, C. I. Pigment Red 184, C. I. Pigment Red 185, C. I. Pigment Red 202, C. I. Pigment Red 206, C. I. Pigment Red 220, C. I. Pigment Red 221, and C. I. Pigment Red 254.

Organic pigments and organic dyes that are yellow colorants can be exemplified by compounds as typified by condensed azo compounds, isoindolinone compounds, anthraquinone compounds, azo-metal complexes, methine compounds, and allylamide compounds. The following are specific examples: C. I. Pigment Yellow 12, C. I. Pigment Yellow 13, C. I. Pigment Yellow 14, C. I. Pigment Yellow 15, C. I. Pigment Yellow 17, C. I. Pigment Yellow 62, C. I. Pigment Yellow 74, C. I. Pigment Yellow 83, C. I. Pigment Yellow 93, C. I. Pigment Yellow 94, C. I. Pigment Yellow 95, C. I. Pigment Yellow 97, C. I. Pigment Yellow 109, C. I. Pigment Yellow 110, C. I. Pigment Yellow 111, C. I. Pigment Yellow 120, C. I. Pigment Yellow 127, C. I. Pigment Yellow 128, C. I. Pigment Yellow 129, C. I. Pigment Yellow 147, C. I. Pigment Yellow 151, C. I. Pigment Yellow 154, C. I. Pigment Yellow 155, C. I. Pigment Yellow 168, C. I. Pigment Yellow 174, C. I. Pigment Yellow 175, C. I. Pigment Yellow 176, C. I. Pigment Yellow 180, C. I. Pigment Yellow 181, C. I. Pigment Yellow 191, and C. I. Pigment Yellow 194.

Black colorants can be exemplified by carbon black and black colorants provided by mixing the above-indicated yellow colorants, magenta colorants, and cyan colorants to give black.

A single such colorant may be used or a mixture of these colorants may be used; these colorants may also be used in the form of the solid solution. The colorant used in the present invention is selected with regard to hue angle, chroma, lightness, lightfastness, OHP transparency, and dispersibility in the toner.

The colorant is preferably used in an addition of 1 to 20 mass parts per 100 mass parts of the polymerizable monomer or binder resin.

When the toner particles are obtained by a suspension polymerization method, precautions must be taken with regard to the ability of the colorant to inhibit the polymerization and the ability of the colorant to migrate into the aqueous phase, and the colorant is preferably subjected in advance to a hydrophobic treatment using a substance that lacks the ability to inhibit polymerization. In particular, dye-based colorants and carbon blacks frequently have the ability to inhibit polymerization and precautions must therefore be taken with their use. In an example of a preferred method for treating a dye-based colorant, the polymerizable monomer is polymerized in advance in the presence of the dye and the obtained colored polymer is then added to the polymerizable monomer composition.

With carbon black, in addition to the same treatment as described above for the dye, a treatment may be carried out using a substance, e.g., a polyorganosiloxane, that reacts with the surface functional groups on the carbon black.

A known charge control agent can be used for the optionally added charge control agent, wherein a preferred charge control agent can in particular increase the charging speed and can stably maintain a specific or prescribed or constant amount of charge. Moreover, when the toner particles are produced by a suspension polymerization method, a particularly preferred charge control agent will have little ability to inhibit polymerization and will be substantially free of material that solubilizes into the aqueous medium. A single charge control agent can be added or a combination of two or more charge control agents can be added.

Charge control agents that control the toner to a negative chargeability can be exemplified by monoazo-metal compounds, acetylacetone-metal compounds, and the metal compounds of aromatic hydroxycarboxylic acids, aromatic dicarboxylic acids, hydroxycarboxylic acids, and dicarboxylic acids. Also included are aromatic hydroxycarboxylic acids and aromatic mono- and polycarboxylic acids and their metal salts, anhydrides, and esters and phenol derivatives such as bisphenol. Additional examples are urea derivatives, metal-containing salicylic acid compounds, metal-containing naphthoic acid compounds, boron compounds, quaternary ammonium salts, and calixarene.

Charge control agents that control the toner to a positive chargeability can be exemplified by nigrosine and nigrosine modified by, e.g., fatty acid metal salts; guanidine compounds; imidazole compounds; quaternary ammonium salts such as tributylbenzylammonium-1-hydroxy-4-naphthosulfonate salts and tetrabutylammonium tetrafluoroborate; onium salts that are analogues to the preceding, such as the phosphonium salt, and their lake pigments; triphenylmethane dyes and their lake pigments, wherein the laking agent can be exemplified by phosphotungstic acid, phosphomolybdic acid, phosphomolybdic tungstic acid, tannic acid, lauric acid, gallic acid, ferricyanide, and ferrocyanide; the metal salts of higher fatty acids; and resin-based charge control agents.

Metal-containing salicylic acid compounds are preferred among the preceding charge control agents wherein the metal therein is particularly preferably aluminum or zirconium. The most preferred charge control agent is the compound aluminum 3,5-di-tert-butylsalicylate.

The amount of charge control agent addition is preferably 0.01 to 20.00 mass parts per 100 mass parts of the polymerizable monomer or binder resin and is more preferably 0.50 to 10.00 mass parts per 100 mass parts of the polymerizable monomer or binder resin.

The charge control agent may also encompass a charge control resin as necessary. This charge control resin is preferably a polymer or copolymer that has a sulfonic acid group, a sulfonate salt group, or a sulfonate ester group. The sulfonic acid group-containing polymer can be exemplified by a styrene-acrylic acid copolymer in which the copolymerization rate for a sulfonic acid group-containing acrylamide monomer (or a sulfonic acid group-containing methacrylamide monomer) is 2 mass % or more (preferably 5 mass % or more). This sulfonic acid group-containing polymer preferably has a glass transition temperature (Tg) of 35° C. to 90° C., a peak molecular weight of 10,000 to 30,000, and a weight-average molecular weight of 25,000 to 50,000.

A polymerization initiator can be used to bring about the polymerization of the polymerizable monomer. Polymerization initiators usable by the present invention can be exemplified by organoperoxide-type initiators and azo-type polymerization initiators. The organoperoxide-type initiators can be exemplified by benzoyl peroxide, lauroyl peroxide, di-α-cumyl peroxide, 2,5-dimethyl-2,5-bis(benzoylperoxy)hexane, bis(4-t-butylcyclohexyl)peroxydicarbonate, 1,1-bis(t-butylperoxy)cyclododecane, t-butylperoxymaleic acid, bis(t-butylperoxy)isophthalate, methyl ethyl ketone peroxide, tert-butylperoxy-2-ethylhexanoate, diisopropyl peroxycarbonate, cumene hydroperoxide, 2,4-dichlorobenzoyl peroxide, and tert-butyl-peroxypivalate. The azo-type polymerization initiators can be exemplified by 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobismethylbutyronitrile.

A redox system initiator, which is the combination of an oxidizing substance with a reducing substance, can also be used as the polymerization initiator. The oxidizing substance can be exemplified by inorganic peroxides such as hydrogen peroxide and the persulfates (e.g., the sodium salt, potassium salt, ammonium salt, and so forth) and by oxidizing metal salts such as tetravalent cerium salts. The reducing substance can be exemplified by reducing metal salts (e.g., divalent iron salts, monovalent copper salts, trivalent chromium salts, and so forth); ammonia; lower amines (e.g., approximately $C_{1-6}$ amines such as methylamine, ethylamine, and so forth); amino compounds such as hydroxylamine and so forth; reducing sulfur compounds such as sodium thiosulfate, sodium hydrosulfite, sodium bisulfite, sodium sulfite, sodium formaldehyde sulfoxylate and its salts, and so forth; approximately $C_{1-6}$ lower alcohols; ascorbic acid and its salts; and approximately $C_{1-6}$ lower aldehydes.

The polymerization initiator is selected based on its 10 hour half-life temperature, and a single polymerization initiator or a mixture of polymerization initiators can be used. The amount of addition for the polymerization initiator will vary as a function of the desired degree of polymerization, but is generally from 0.50 mass part or more and 20.00 mass parts or more per 100 mass parts of the polymerizable monomer.

In addition, for example, a known polymerization inhibitor and a known chain transfer agent for control of the degree of polymerization can also be added and used.

Known inorganic and organic dispersion stabilizers can be used as the dispersion stabilizer employed in the preparation of the above-described aqueous medium. Specific examples of inorganic compounds are tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Specific examples of organic compounds are polyvinyl alcohol, gelatin, methyl cellulose, methylhydroxypropyl cellulose, ethyl cellulose, the sodium salt of carboxymethyl cellulose, polyacrylic acid and its salts, and starch. The amount of use for these dispersion stabilizers is preferably from at least 0.20 mass part to not more than 20.00 mass parts per 100 mass parts of the polymerizable monomer.

When among these dispersion stabilizers an inorganic compound is employed, the commercially available inorganic compounds may be directly used as such; however, the inorganic compound may also be produced in the aqueous medium in order to obtain fine particles. In the case of, for example, tricalcium phosphate, an aqueous sodium phosphate solution may be mixed with an aqueous calcium chloride solution with vigorous stirring.

The external addition of additives to the toner particles may be carried out for the purpose of imparting various properties to the toner. Additives for improving toner fluidity can be exemplified by inorganic fine powders such as silica fine powder, titanium oxide fine powder, and their double oxide fine powders. Silica fine powder and titanium oxide fine powder are preferred among the inorganic fine powders.

The silica fine powder can be exemplified by the fumed silicas and dry silicas produced via the vapor-phase oxidation of a silicon halide and by the wet silicas produced from water glass. A more preferred inorganic fine powder is a dry silica that contains little $Na_2O$ and $SO_3^{2-}$ and that contains little silanol group on the surface and in the interior of the silica fine powder. In addition, the dry silica may be a composite fine powder of silica with another metal oxide, as obtained by using a combination of the silicon halide compound with another metal halide compound, e.g., aluminum chloride or titanium chloride, in the production process.

The inorganic fine powder is preferably used in the form of an inorganic fine powder that has been subjected to a hydrophobic treatment; this is because an improved control of the amount of toner charging, an improved environmental stability for the toner, and improved properties in a high humidity environment can be achieved by the execution of a hydrophobic treatment on the surface of the inorganic fine powder using a treatment agent. The addition of a hygroscopic inorganic fine powder to the toner results in a reduction in the amount of toner charging and readily causes a decline in the developing performance and transfer properties.

The treatment agent for performing the hydrophobic treatment on the inorganic fine powder can be exemplified by unmodified silicone varnishes, various modified silicone varnishes, unmodified silicone oils, various modified silicone oils, silane compounds, silane coupling agents, other organosilicon compounds, and organotitanium compounds. A single treatment agent may be used or a combination of treatment agents may be used. Silicone oil-treated inorganic fine powders are preferred among the preceding.

The total amount of inorganic fine powder is preferably from 1.00 to 5.00 mass parts per 100 mass parts of the toner particles and more preferably is from 1.00 mass part to 2.50 mass parts per 100 mass parts of the toner particles. Viewed from the perspective of the durability when added to the toner, the external additives preferably have a particle diameter that is not greater than one-tenth the average particle diameter of the toner particles.

The methods used to measure the various properties referenced by the present invention are described herebelow.

<Calculation of the Average Number of Moles of Alkylene Oxide (AO) Addition in the Nonionic Surfactant>

The average number of moles of alkylene oxide (AO) addition in the nonionic surfactant is determined in the present invention as follows using $^1$H-NMR (nuclear magnetic resonance) measurement.

First, 10 mg of the nonionic surfactant is weighed out and dissolved with 10 mg of deuterochloroform containing trimethylsilane (TMS, 1% TMS) and this is analyzed by $^1$H-NMR. The average number of moles of addition is calculated from the peak intensity ratios.

The measurement instrument and measurement conditions are as follows.

instrument: JNM-EX400 FT-NMR instrument (JEOL Ltd.)
measurement frequency: 400 MHz
pulse condition: 5.0 μs
frequency range: 10500 Hz
number of scans: 1024
measurement temperature: 40° C.

<Calculation of the HLB Value for the Nonionic Surfactant>

The hydrophile-lipophile balance value (HLB value) of the nonionic surfactant was determined in the present invention based on Griffin's HLB formula as shown below.

$$\text{nonionic surfactant } HLB = \frac{\text{molecular weight of the hydrophilic moiety}}{\text{molecular weight of the surfactant}} \times \frac{100}{5} \quad \text{[Expression 1]}$$

<Measurement of the Weight-Average Particle Diameter (D4) of the Toner and the Number-Average Particle Diameter (D1) of the Toner>

The weight-average particle diameter (D4) of the toner and the number-average particle diameter (D1) of the toner are calculated as follows. The measurement instrument used is a Coulter Counter Multisizer 3 (registered trademark of Beckman Coulter, Inc.), which is a precision particle diameter distribution analyzer that uses the aperture electrical resistance principle and is equipped with a 100 μm aperture tube. The measurement conditions are set and the measurement data is analyzed using the Beckman Coulter Multisizer 3 Version 3.51 software (from Beckman Coulter, Inc.) provided with the instrument. The measurements are performed using 25,000 channels for the number of effective measurement channels.

A solution of special grade sodium chloride dissolved in ion-exchanged water and brought to a concentration of approximately 1 mass %, for example, "ISOTON II" from Beckman Coulter, Inc., can be used for the aqueous electrolyte solution used for the measurement.

The dedicated software is set as follows prior to running the measurement and analysis.

On the "Change Standard Operating Method (SOM)" screen of the dedicated software, the total count number for the control mode is set to 50000 particles, the number of measurements is set to 1, and the value obtained using "10.0 μm standard particles" (from Beckman Coulter, Inc.) is set for the Kd value. The threshold and noise level are automatically set by pressing the "measurement threshold/noise level button". The current is set to 1600 μA, the gain is set to 2, the electrolyte solution is set to ISOTON II, and "flush aperture tube after measurement" is checked.

On the "pulse-to-particle diameter conversion setting" screen of the dedicated software, the bin interval is set to logarithmic particle diameter, the particle diameter bin is set to 256 particle diameter bins, and the particle diameter range is set to from 2 μm to 60 μm.

The specific measurement method is as follows.

(1) Approximately 200 mL of the above-described aqueous electrolyte solution is introduced into the glass 250-mL roundbottom beaker provided for use with the Multisizer 3 and this is then set into the sample stand and counterclockwise stirring is performed with a stirring rod at 24 rotations per second. Dirt and bubbles in the aperture tube are removed using the "aperture flush" function of the dedicated software.

(2) Approximately 30 mL of the above-described aqueous electrolyte solution is introduced into a glass 100-mL flat-bottom beaker. To this is added the following as a dispersing agent: approximately 0.3 mL of a dilution prepared by diluting "Contaminon N" approximately 3-fold on a mass basis with ion-exchanged water; "Contaminon N" is a 10 mass % aqueous solution of a pH 7 detergent for cleaning precision measurement instrumentation and comprises a nonionic surfactant, an anionic surfactant, and an organic builder, from Wako Pure Chemical Industries, Ltd.

(3) An "Ultrasonic Dispersion System Tetora 150" ultrasound disperser from Nikkaki Bios Co., Ltd., is prepared; this has an output of 120 W and is equipped with two oscillators oscillating at 50 kHz and configured with a phase shift of 180°. A prescribed amount of ion-exchanged water is introduced into the water tank of the ultrasound disperser and approximately 2 mL of the above-referenced Contaminon N is added to the water tank.

(4) The beaker from (2) is placed in the beaker holder of the ultrasound disperser and the ultrasound disperser is activated. The height position of the beaker is adjusted to provide the maximum resonance state for the surface of the aqueous electrolyte solution in the beaker.

(5) While exposing the aqueous electrolyte solution in the beaker of (4) to the ultrasound, approximately 10 mg of the toner is added in small portions to the aqueous electrolyte solution and is dispersed. The ultrasound dispersing treatment is continued for another 60 seconds. During ultrasound dispersion, the water temperature in the water tank is adjusted as appropriate to be 10° C. or more and 40° C. or less.

(6) Using a pipette, the aqueous electrolyte solution from (5) containing dispersed toner is added dropwise into the roundbottom beaker of (1) that is installed in the sample stand and the measurement concentration is adjusted to approximately 5%. The measurement is run until the number of particles measured reaches 50000.

(7) The measurement data is analyzed by the dedicated software provided with the instrument to calculate the weight-average particle diameter (D4) and the number-average particle diameter (D1). When the dedicated software is set to graph/volume %, the "average diameter" on the "analysis/volume statistics (arithmetic average)" screen is the weight-average particle diameter (D4); when the dedicated software is set to graph/number %, the "average diameter" on the "analysis/number statistics (arithmetic average)" screen is the number-average particle diameter (D1).

<Measurement of the Amount of Toner Particles Less Than or Equal to 2 μm>

The amount of toner particles less than or equal to 2 μm is measured using an "FPIA-3000", a flow-type particle image analyzer from the Sysmex Corporation. The details are provided below.

Approximately 10 mL ion-exchanged water that has been precleaned of, e.g., solid impurities, is placed in a glass container. To this is added the following as a dispersing agent: approximately 0.1 mL of a dilution prepared by diluting "Contaminon N" approximately 3-fold on a mass basis with ion-exchanged water; "Contaminon N" is a 10 mass % aqueous solution of a pH 7 detergent for cleaning precision instrumentation, comprising a nonionic surfactant, an anionic surfactant, and an organic builder, from Wako Pure Chemical Industries, Ltd. Approximately 0.02 g of the measurement sample is then added and a dispersion treatment is performed for 2 minutes using an ultrasound disperser to provide a dispersion to be subjected to measurement. An "Ultrasonic Dispersion System Tetora 150" ultrasound disperser from Nikkaki Bios Co., Ltd., is used as the ultrasound disperser; this has an output of 120 W and is equipped with two oscillators oscillating at 50 kHz and configured with a phase shift of 180°. A prescribed amount of ion-exchanged water is introduced into the water tank of the ultrasound disperser and approximately 2 mL of the above-described Contaminon N is then added to the water tank. Appropriate cooling is implemented at this time so as to prevent the temperature of the dispersion from reaching 40° C. or above. In order to inhibit measurement variations, the ambient environment for the instrument is controlled to 23° C.±0.5° C. in order to bring the temperature within the "FPIA-3000" flow-type particle image analyzer to 26° C. to 27° C. In addition, at a prescribed time interval and preferably every 2 hours, automatic focusing is performed using standard 2 μm latex particles (for example, a dilution with ion-exchanged water of "RESEARCH AND TEST PARTICLES Latex Microsphere Suspensions 5200A" from Duke Scientific).

"PSE-900A" particle sheath from the Sysmex Corporation is used for the sheath liquid. The dispersion prepared according to the above-described procedure is introduced into the indicated flow-type particle image analyzer and measurement is performed after re-adjusting the dispersion concentration to provide a toner particle concentration during measurement of approximately 5000 toner particles/μL. After the measurement, the data is used to determine the amount of toner particles, in number %, less than or equal to 2 μm.

EXAMPLES

Hereinafter, the present invention will be described more specifically by way of examples. The present invention is not limited by the following examples insofar as the essential features of the present invention are not exceeded. Unless specifically indicated otherwise, the parts and % in the examples and comparative examples are on a mass basis in all instances.

The surfactant used in the examples will now be described.

<Production of Surfactant 1>

186 g lauryl alcohol and 1.0 g sodium hydroxide were introduced into a three-neck flask fitted with a reflux condenser and a stirrer and were heated to 180° C. with vigorous stirring. Then, 419.0 g ethylene oxide and 27.5 propylene oxide were injected into the solution and an addition reaction was carried out. The sodium hydroxide in the reaction solution was neutralized with acid followed by filtration and molecular distillation to obtain surfactant 1. The properties of the obtained surfactant 1 are shown in Table 2.

<Production of Surfactants 2 to 12>

Surfactants 2 to 12 were obtained in the same way as in the production of surfactant 1, except changing the lauryl alcohol, ethylene oxide (EO), or propylene oxide (PO) in the surfactant 1 production method as shown in Table 1. The properties of the obtained surfactants 2 to 12 are shown in Table 2.

The purified reagents shown below were used for surfactants 13 to 15. The properties of surfactants 13 to 15 are shown in Table 2.

surfactant 13: sodium dodecyl sulfate (Kishida Chemical Co., Ltd.)

surfactant 14: cetyltrimethylammonium bromide (Kishida Chemical Co., Ltd.)

surfactant 15: sucrose monolaurate (Kishida Chemical Co., Ltd.)

TABLE 1

| | | | EO | PO |
|---|---|---|---|---|
| surfactant 1 | lauryl alcohol | 186 g | 419.0 g | 27.5 g |
| surfactant 2 | pentadecyl alcohol | 228 g | 209.5 g | 14.0 g |
| surfactant 3 | octyl alcohol | 130 g | 838.0 g | 55.5 g |
| surfactant 4 | arachidic acid | 312 g | 389.5 g | 69.0 g |
| surfactant 5 | butyric acid | 88 g | 419.0 g | 27.5 g |
| surfactant 6 | amyl alcohol | 88 g | 313.0 g | 174.0 g |
| surfactant 7 | octyl alcohol | 130 g | 838.0 g | 55.0 g |
| surfactant 8 | sorbitan monostearate | 430 g | 880.0 g | — |
| surfactant 9 | nonylphenol | 220 g | 616.0 g | — |
| surfactant 10 | octadecyl alcohol | 270 g | 660.0 g | — |
| surfactant 11 | nonadecyl alcohol | 284 g | 220.0 g | — |
| surfactant 12 | butyl alcohol | 130 g | 440.0 g | — |

TABLE 2

| | classification | | | AO composition | Average number of moles of AO addition | HLB value |
|---|---|---|---|---|---|---|
| surfactant 1 | nonionic | polyalkylene glycol | higher alcohol alkylene oxide adduct | EO:PO 20:1 | 10 | 13.4 |
| surfactant 2 | nonionic | polyalkylene glycol | higher alcohol alkylene oxide adduct | EO:PO 20:1 | 5 | 9.4 |
| surfactant 3 | nonionic | polyalkylene glycol | higher alcohol alkylene oxide adduct | EO:PO 20:1 | 20 | 16.5 |
| surfactant 4 | nonionic | polyalkylene glycol | fatty acid alkylene oxide adduct | EO:PO 20:3 | 10 | 10.1 |
| surfactant 5 | nonionic | polyalkylene glycol | fatty acid alkylene oxide adduct | EO:PO 20:1 | 10 | 15.8 |
| surfactant 6 | nonionic | polyalkylene glycol | higher alcohol alkylene oxide adduct | EO:PO 20:10 | 10 | 10.9 |
| surfactant 7 | nonionic | polyalkylene glycol | higher alcohol alkylene oxide adduct | EO:PO 20:1 | 20 | 14.9 |
| surfactant 8 | nonionic | polyhydric alcohol | alkylene oxide adduct | EO | 20 | 14.9 |
| surfactant 9 | nonionic | polyalkylene glycol | Alkylphenol alkylene oxide adduct | EO | 14 | 14.8 |
| surfactant 10 | nonionic | polyalkylene glycol | higher alcohol alkylene oxide adduct | EO | 15 | 14.2 |
| surfactant 11 | nonionic | polyalkylene glycol | higher alcohol alkylene oxide adduct | EO | 5 | 8.7 |
| surfactant 12 | nonionic | polyalkylene glycol | higher alcohol alkylene oxide adduct | EO | 10 | 17.2 |
| surfactant 13 | anionic | — | — | — | — | — |
| surfactant 14 | cationic | — | — | — | — | — |
| surfactant 15 | nonionic | polyhydric alcohol | — | — | — | 12.4 |

<Production of a Negative Chargeability Control Resin>

The following were introduced into pressurizable reactor provided with a reflux condenser, stirrer, thermometer, nitrogen introduction tube, dropping funnel, and depressurization device and were heated to the reflux temperature while stirring: 255 mass parts of methanol, 145 mass parts of 2-butanone, and 100 mass parts of 2-propanol as the solvent; 88 mass parts of styrene, 6.2 mass parts of 2-ethylhexyl acrylate, and 5.1 mass parts of 2-acrylamido-2-methylpropanesulfonic acid as the monomer. A solution of 1.0 mass part of the polymerization initiator 2,2'-azobisisobutyronitrile diluted with 20 mass parts of 2-butanone was added dropwise over 30 minutes and stirring was continued for 5 hours. A solution prepared by diluting 1.2 mass parts 2,2'-azobisisobutyronitrile with 20 mass parts 2-butanone was then added dropwise over 30 minutes and stirring was performed for an additional 5 hours to complete the polymerization.

The polymer obtained by distilling out the polymerization solvent under reduced pressure was then coarsely pulverized to 100 μm or less using a cutter mill equipped with a 150-mesh screen (104 μm mesh aperture) and was subsequently micropulverized using a jet mill. This fine powder was classified using a 250-mesh sieve (61 μm mesh aperture) and the particles less than or equal to 60 μm were separated and recovered. These particles were then dissolved by the addition of sufficient methyl ethyl ketone (MEK) to provide a 10% concentration. Reprecipitation was carried out by gradually introducing this solution into 20-fold (versus the MEK) methanol. The precipitate was washed with half of the methanol used for reprecipitation and the filtered particles were dried in a vacuum for 48 hours at 35° C.

After this vacuum drying, the particles were redissolved by the addition of sufficient MEK to give a concentration of 10%, and reprecipitation was carried out by the gradual addition of this solution to 20-fold (versus the MEK) n-hexane. The obtained precipitate was washed with half of the n-hexane used for the reprecipitation and the filtered particles were vacuum dried for 48 hours at 35° C. The resin obtained in this manner had a glass transition temperature (Tg) of approximately 83° C., a main peak molecular weight (Mp) of 21,400, a number-average molecular weight (Mn) of 11,100, a weight-average molecular weight (Mw) of 33,200, and an acid value of 14.5 mg KOH/g. The composition measured by $^{1}$H-NMR (EX-400 from JEOL: 400 MHz) agreed with the charge quantities. The obtained resin was a negative chargeability control resin.

<Production of Toner 1>

35.0 mass parts of styrene monomer, 4.0 mass parts of C. I. Pigment Red 122, 2.0 mass parts of C. I. Pigment Red 150, 0.50 mass part of aluminum 3,5-di-tertiary-butylsalicylate compound (Bontron E88 from Orient Chemical Industries Co., Ltd.), 0.20 mass part of the above-described negative chargeability control resin, and 0.10 mass part of surfactant 1 were prepared. These were introduced into an attritor (Mitsui Mining Co., Ltd. [today's Nippon Coke & Engineering Co., Ltd.]) and a liquid mixture was prepared. This was followed by stirring for 300 minutes at 25° C. and 200 rpm using this attritor and zirconia beads (140 mass parts) having a radius of 1.25 mm.

This was followed by the addition of 43.0 mass parts of styrene monomer, 22.0 mass parts of n-butyl acrylate monomer, 10.0 mass parts of hydrocarbon wax (Fischer-Tropsch wax, peak temperature of highest endothermic peak=78° C., Mw=750), and 4.0 mass parts of polyester resin (polycondensate of terephthalic acid:isophthalic acid:propylene oxide-modified bisphenol A (2 mol adduct):ethylene oxide-modified bisphenol A (2 mol adduct)=30:30:30:10 (mass ratio), acid value=11 mg KOH/g, Tg=74° C., Mw=11,000, Mn=4,000) and heating to 65° C. and dispersion•dissolution to uniformity was performed at 5,000 rpm using a T.K. Homomixer (Tokushu Kika Kogyo Co., Ltd.) to obtain a colorant-dispersed solution. This was followed by holding at quiescence for 72 hours to obtain a colorant-dispersed solution (post-standing).

17 mass parts of sodium phosphate was introduced into 220 mass parts of ion-exchanged water and heated to 60° C. and 20 mass parts of an aqueous 1.0 mol/liter $CaCl_2$ solution was gradually added to prepare an aqueous medium that contained a calcium phosphate compound.

Into this aqueous medium were introduced the above-described colorant-dispersed solution (post-standing) and 7.2 mass parts of a 70% toluene solution of the polymerization initiator 1,1,3,3-tetramethylbutylperoxy 2-ethylhexanoate. Stirring was performed for 10 minutes at 65° C. under an $N_2$ atmosphere at 12,000 rpm using a T.K. Homomixer to granulate the colorant-dispersed solution. Heating to a temperature of 67° C. was then carried out while stirring with paddle stirring blades, and, when the polymerization conversion of the polymerizable vinyl monomer had reached 90%, the pH of the aqueous medium was adjusted to 9 by the addition of an aqueous 0.1 mol/liter sodium hydroxide solution. Heating to 80° C. was carried out at a temperature rise rate of 40° C./h and a reaction was conducted for 5 hours. After the completion of the polymerization reaction, the residual monomer in the toner particles was distilled out under reduced pressure. The aqueous medium was cooled to obtain a toner particles 1-dispersed solution.

Hydrochloric acid was added to the obtained the toner particles 1-dispersed solution to bring the pH to 1.4 and the calcium phosphate salt was dissolved by stirring for 1 hour. This toner particles-dispersed solution was filtered using a pressure filter and the resulting damp toner particles were washed to obtain a toner cake. This toner cake was then pulverized and dried to obtain toner particles 1.

To 100 mass parts of the obtained toner particles 1 was added 1.5 mass parts of a hydrophobic silica fine powder (number-average primary particle diameter: 10 nm) that had been surface-treated with hexamethyldisilazane. A mixing process was carried out for 300 seconds with a Henschel mixer (Mitsui Mining Co., Ltd. [today's Nippon Coke & Engineering Co., Ltd.]) to obtain toner 1.

<Production of Toner 2>

35.0 mass parts of styrene monomer, 4.0 mass parts of C. I. Pigment Red 122, 2.0 mass parts of C. I. Pigment Red 150, 0.50 mass part of aluminum 3,5-di-tertiary-butylsalicylate compound (Bontron E88 from Orient Chemical Industries Co., Ltd.), and 0.20 mass part of the above-described negative chargeability control resin were prepared. These were introduced into an Attritor (manufactured by Mitsui Mining Co., Ltd. [today's Nippon Coke & Engineering Co., Ltd.], and stirred using an attritor for 300 minutes at 25° C. and 200 rpm using zirconia beads (140 mass parts) having a radius of 1.25 mm.

This was followed by the addition of 43.0 mass parts of styrene monomer, 22.0 mass parts of n-butyl acrylate monomer, 10.0 mass parts of hydrocarbon wax (Fischer-Tropsch wax, peak temperature of highest endothermic peak=78° C., Mw=750), 4.0 mass parts of polyester resin (polycondensate of terephthalic acid:isophthalic acid:propylene oxide-modified bisphenol A (2 mol adduct):ethylene oxide-modified bisphenol A (2 mol adduct)=30:30:30:10 (mass ratio), acid value=11 mg KOH/g, Tg=74° C., Mw=11,000, Mn=4,000), and 0.10 mass part of surfactant 1 and a liquid mixture was prepared. This was followed by heating to 65° C. and dispersion•dissolution to uniformity was performed at 5,000 rpm using a T.K. Homomixer (Tokushu Kika Kogyo Co., Ltd.) to obtain a colorant-dispersed solution. This dispersed solution was then held at quiescence for 72 hours to obtain a colorant-dispersed solution (post-standing).

17 mass parts of sodium phosphate was introduced into 220 mass parts of ion-exchanged water and heated to 60° C. and 20 mass parts of an aqueous 1.0 mol/liter $CaCl_2$ solution was gradually added to prepare an aqueous medium that contained a calcium phosphate compound.

Into this aqueous medium were introduced the above-described colorant-dispersed solution (post-standing) and 7.2 mass parts of a 70% toluene solution of the polymerization initiator 1,1,3,3-tetramethylbutylperoxy 2-ethylhexanoate. Stirring was performed for 10 minutes at 65° C. under an $N_2$ atmosphere at 12,000 rpm using a T.K. Homomixer to granulate the colorant-dispersed solution. Heating to a temperature of 67° C. was then carried out while stirring with paddle stirring blades, and, when the polymerization conversion of the polymerizable vinyl monomer had reached 90%, the pH of the aqueous medium was adjusted to 9 by the addition of an aqueous 0.1 mol/liter sodium hydroxide solution. Heating to 80° C. was carried out at a temperature rise rate of 40° C./h and a reaction was conducted for 5 hours. After the completion of the polymerization reaction, the residual monomer in the toner particles was distilled out under reduced pressure. The aqueous medium was cooled to obtain a toner particles 2-dispersed solution.

Hydrochloric acid was added to the obtained toner particles 2-dispersed solution to bring the pH to 1.4 and the calcium phosphate salt was dissolved by stirring for 1 hour. This dispersed solution was filtered using a pressure filter and the resulting damp toner particles were washed to obtain a toner cake. This toner cake was then pulverized and dried to obtain toner particles 2.

To 100 mass parts of the obtained toner particles 2 was added 1.5 mass parts of a hydrophobic silica fine powder (number-average primary particle diameter: 10 nm) that had been surface-treated with hexamethyldisilazane. A mixing process was carried out for 300 seconds with a Henschel mixer (Mitsui Mining Co., Ltd. [today's Nippon Coke & Engineering Co., Ltd.]) to obtain toner 2.

<Production of Toners 3 to 17 and 19 to 24>

Toners 3 to 17 and 19 to 24 were obtained in the same way as in the method of producing toner 1, with the exception that surfactant 1 was changed to the surfactant shown in Table 3 and the number of parts of addition was changed as shown in Table 3.

<Production of Toner 18>

| | |
|---|---|
| polyester A (polycondensate of terephthalic acid:isophthalic acid:propylene oxide-modified bisphenol A (2 mol adduct):ethylene oxide-modified bisphenol A (2 mol adduct) = 20:20:44:50 (mass ratio), Mw = 7,000, Mn = 3,200, Tg = 57° C.) | 45.0 mass parts |
| polyester B (polycondensate of terephthalic acid:trimellitic acid:propylene oxide-modified bisphenol A (2 mol adduct):ethylene oxide-modified bisphenol A (2 mol adduct) = 24:3:70:2 (mass ratio), Mw = 11,000, Mn = 4,200, Tg = 52° C.) | 40.0 mass parts |
| methyl ethyl ketone | 80.0 mass parts |
| ethyl acetate | 80.0 mass parts |
| hydrocarbon-based wax (Fischer-Tropsch wax, highest endothermic peak = 78° C., Mw = 750) | 7.0 mass parts |
| C.I. Pigment Red 122 | 4.0 mass parts |

-continued

| | |
|---|---|
| C.I. Pigment Red 150 | 2.0 mass parts |
| the above-described negative chargeability control resin | 1.9 mass parts |
| surfactant 1 (0.10 mass part per 100 mass parts of the total of polyesters A and B) | 0.085 mass part |

These components were introduced into an attritor (Mitsui Mining & Smelting Co., Ltd.) and a liquid mixture was prepared. A dispersion treatment was then conducted for 3 hours with the attritor to obtain a colorant-dispersed solution. The obtained colorant-dispersed solution was held at quiescence for 72 hours to obtain a colorant-dispersed solution (post-standing).

17 mass parts of sodium phosphate was introduced into 220 mass parts of ion-exchanged water and heated to 60° C. and 20 mass parts of an aqueous 1.0 mol/liter $CaCl_2$ solution was gradually added to prepare an aqueous medium that contained a calcium phosphate compound.

Into this aqueous medium was introduced the above-described colorant-dispersed solution (post-standing) and stirring was performed for 15 minutes at 65° C. under an $N_2$ atmosphere at 12,000 rpm using a T.K. Homomixer to granulate the colorant-dispersed solution. Following transfer from the T.K. Homomixer to a standard propeller stirring apparatus, the interior temperature was raised to 95° C. while maintaining the stirring rotation rate of the stirrer at 150 rpm and the solvent was removed by holding for 3 hours to obtain an aqueous medium in which resin particles were dispersed.

Hydrochloric acid was added to the aqueous medium containing the dispersed resin particles to bring the pH to 1.4 and the calcium phosphate salt was dissolved by stirring for 1 hour. This dispersed-solution was filtered using a pressure filter and the resulting damp toner particles were washed to obtain a toner cake. This toner cake was then pulverized and dried to obtain toner particles.

To 100 mass parts of the obtained toner particles was added 1.50 mass parts of a hydrophobic silica fine powder (number-average primary particle diameter: 10 nm) that had been surface-treated with hexamethyldisilazane. A mixing process was carried out for 300 seconds with a Henschel mixer (Mitsui Mining Co., Ltd. [today's Nippon Coke & Engineering Co., Ltd.]) to obtain toner 18.

<Production of Toners 25 to 31>

Toners 25 to 31 were obtained in the same way as in the method of producing toner 1, with the exception that the C. I. Pigment Red 122 and C. I. Pigment Red 150 were changed to the colorants shown in Table 4 and the number of parts of addition was changed as shown in Table 4.

TABLE 3

| | production method | surfactant | no. of parts of addition (mass parts) |
|---|---|---|---|
| Toner 1 | suspension polymerization | Surfactant 1 | 0.10 |
| Toner 2 | suspension polymerization | Surfactant 1 | 0.10 |
| Toner 3 | suspension polymerization | Surfactant 2 | 0.10 |
| Toner 4 | suspension polymerization | Surfactant 3 | 0.10 |
| Toner 5 | suspension polymerization | Surfactant 4 | 0.10 |

TABLE 3-continued

| | production method | surfactant | no. of parts of addition (mass parts) |
|---|---|---|---|
| Toner 6 | suspension polymerization | Surfactant 5 | 0.10 |
| Toner 7 | suspension polymerization | Surfactant 6 | 0.10 |
| Toner 8 | suspension polymerization | Surfactant 7 | 0.10 |
| Toner 9 | suspension polymerization | Surfactant 8 | 0.10 |
| Toner 10 | suspension polymerization | Surfactant 9 | 0.10 |
| Toner 11 | suspension polymerization | Surfactant 10 | 0.10 |
| Toner 12 | suspension polymerization | Surfactant 9 | 0.03 |
| Toner 13 | suspension polymerization | Surfactant 9 | 0.50 |
| Toner 14 | suspension polymerization | Surfactant 9 | 0.05 |
| Toner 15 | suspension polymerization | Surfactant 9 | 0.40 |
| Toner 16 | suspension polymerization | Surfactant 9 | 0.01 |
| Toner 17 | suspension polymerization | Surfactant 9 | 0.55 |
| Toner 18 | solution suspension | Surfactant 1 | 0.10 |
| Toner 19 | suspension polymerization | Surfactant 11 | 0.10 |
| Toner 20 | suspension polymerization | Surfactant 12 | 0.10 |
| Toner 21 | suspension polymerization | Surfactant 13 | 0.10 |
| Toner 22 | suspension polymerization | Surfactant 14 | 0.10 |
| Toner 23 | suspension polymerization | Surfactant 15 | 0.10 |
| Toner 24 | suspension polymerization | — | — |

In the case of the suspension polymerization method, the no. of parts of addition is the value per 100 mass parts of the polymerizable monomer; in the case of the solution suspension method, the no. of parts of addition is the value per 100 mass parts of the dissolved resin.

TABLE 4

| | Colorant | no. of mass parts |
|---|---|---|
| Toner 1 | C.I. Pigment Red 122 | 4.00 |
| | C.I. Pigment Red 150 | 2.00 |
| Toner 25 | C.I. Pigment Red 269 | 6.50 |
| Toner 26 | C.I. Pigment Yellow 74 | 5.50 |
| Toner 27 | C.I. Pigment Yellow 93 | 5.50 |
| Toner 28 | C.I. Pigment Yellow 155 | 5.50 |
| Toner 29 | C.I. Pigment Yellow 180 | 5.50 |
| Toner 30 | C.I. Pigment Yellow 185 | 5.50 |
| Toner 31 | C.I. Pigment Blue 15:3 | 5.50 |

Examples 1 to 25 and Comparative Examples 1 to 6

The following evaluations were performed using the obtained toners 1 to 31. The results of these evaluations are given in Table 5.

<Toner Evaluation>

Pigment Dispersibility

To evaluate the pigment dispersibility, 5 toners were randomly selected and the TEM image of the toner cross section was photographed. The obtained image was checked visually and evaluated using the scale given below. The toners produced in the examples were in all instances produced by carrying out granulation after standing for 72 hours after production of the colorant-dispersed solution and thus were produced under conditions that tended to facilitate the production of pigment aggregates.

Evaluation Scale

A: pigment aggregates were not seen, the dispersion was excellent

B: less than 5 pigment aggregates

C: 5 or more pigment aggregates, but less than 10 pigment aggregates

D: 10 or more pigment aggregates, or a pigment aggregate greater than or equal to 0.5 μm was produced Toner Particle Diameter Distribution (D4/D1)

The toner particle diameter distribution was evaluated through the [weight-average particle diameter (D4)/number-average particle diameter (D1)] obtained using the Beckman Coulter Multisizer 3 (registered trademark, product of Beckman Coulter Inc.) precision particle diameter distribution analyzer. Smaller values are indicative of a sharper particle diameter distribution.

Evaluation Scale

A: less than 1.15

B: 1.15 or more and less than 1.20

C: 1.20 or more and less than 1.30

D: 1.30 or more

Proportion of Toner Particles Less Than or Equal to 2.0 μm

The amount of particles less than or equal to 2.0 μm, which generally correlates with the amount of emulsified particle production, was measured using an "FPIA-3000" flow-type particle image analyzer from the Sysmex Corporation.

Evaluation Scale

A: less than 3.00 number %

B: 3.00 number % or more and less than 5.00 number %

C: 5.00 number % or more and less than 10.00 number %

D: 10.00 number % or more

<Evaluation of Image Output>

The evaluation of the image output was performed using a device provided by modifying a commercial HP Color LaserJet 3525dn color laser printer from Hewlett-Packard so it would also operate with just a single color process cartridge installed.

The toner contained in a commercial black cartridge was removed and the interior was cleaned with an air blower. The cartridge was then loaded with 300 g of the toner to be evaluated and with a toner carrying member and the developing performance and durability were evaluated. The items evaluated are given below. Letter size XEROX 4200 paper (75 g/m$^2$, from the Xerox Corporation) was used for the transfer material.

Image Density 25000 prints of a horizontal line image with a print percentage of 1% were printed out in a high temperature, high humidity environment (30° C./85% RH) and a solid black image was then printed out and the image density was evaluated based on the image density in the solid black region. A MacBeth RD918 Reflection Densitometer (MacBeth) was used to measure the image density. The relative density was measured with respect to the printed out image of the white background region where the original had a density of 0.00.

Evaluation Scale

A: 1.45 or more

B: 1.35 or more and less than 1.45

C: 1.30 or more and less than 1.35

D: 1.20 or more and less than 1.30

E: less than 1.20

Durability 25000 prints of a horizontal line image with a print percentage of 1% were printed out in a low temperature, low humidity environment (10° C./10% RH), after which the presence/absence of toner contamination on the developing roller (developer carrying member) was visually checked. In addition, 25000 prints of a horizontal line image with a print percentage of 1% were printed out in a high temperature, high humidity environment (30° C./85% RH), after which a halftone image (toner placement amount: 0.6 mg/cm$^2$) was printed out and the presence/absence of development stripes was checked.

Evaluation Scale

A: member contamination and development stripes were both absent

B: slight member contamination was produced, or a development stripe was produced in at least 1 location but in no more than 3 locations C: member contamination was produced, not slight but not at a level that would be problematic in practice, or a development stripe was produced in at least 4 locations but in no more than 6 locations D: unacceptable member contamination was produced, or a development stripe was produced in at least 7 locations, or a development stripe was produced over 0.5 mm or more of width Fogging 25000 prints of a horizontal line image with a print percentage of 1% were printed out in a high temperature, high humidity environment (30° C./85% RH) and, after standing for 48 hours, the reflectance (%) of the nonimage region of another printed out image was measured using a Model TC-6DS Reflectometer from Tokyo Denshoku Co., Ltd. The evaluation was performed using the numerical value (%) provided by subtracting the obtained reflectance from the reflectance (%) measured in the same manner on the unused print paper (standard paper). Smaller numerical values are indicative of a greater inhibition of image fogging.

Evaluation Scale

A: less than 0.5%

B: 0.5% or more and less than 1.5%

C: 1.5% or more and less than 3.0%

D: 3.0% or more

TABLE 5

| | | pigment dispersion | (D4/D1) | amount of particles less than or equal to 2.0 μm | image density | durability | fogging |
|---|---|---|---|---|---|---|---|
| Example 1 | Toner 1 | A | A(1.10) | A(2.13) | A(1.50) | A | A(0.2) |
| Example 2 | Toner 2 | B | A(1.14) | A(2.50) | A(1.46) | A | A(0.3) |
| Example 3 | Toner 3 | C | A(1.13) | A(2.41) | C(1.34) | B | A(0.3) |
| Example 4 | Toner 4 | A | A(1.12) | C(8.22) | A(1.48) | A | C(2.6) |
| Example 5 | Toner 5 | B | A(1.14) | A(2.51) | B(1.43) | B | A(0.2) |
| Example 6 | Toner 6 | A | A(1.13) | B(3.11) | A(1.48) | A | B(0.6) |
| Example 7 | Toner 7 | A | A(1.11) | A(2.03) | A(1.49) | A | A(0.3) |
| Example 8 | Toner 8 | A | A(1.10) | A(2.32) | A(1.51) | A | A(0.3) |
| Example 9 | Toner 9 | B | B(1.18) | B(3.99) | B(1.38) | B | B(0.8) |
| Example 10 | Toner 10 | B | A(1.14) | A(2.83) | B(1.41) | B | A(0.2) |
| Example 11 | Toner 11 | B | A(1.13) | A(2.69) | B(1.43) | A | A(0.2) |
| Example 12 | Toner 12 | B | B(1.17) | A(2.44) | B(1.38) | B | A(0.3) |
| Example 13 | Toner 13 | B | B(1.18) | C(6.32) | B(1.36) | A | C(1.9) |
| Example 14 | Toner 14 | B | A(1.13) | A(2.63) | B(1.40) | B | A(0.4) |
| Example 15 | Toner 15 | B | A(1.14) | A(2.80) | B(1.42) | B | A(0.3) |
| Example 16 | Toner 16 | B | C(1.22) | A(2.19) | C(1.33) | C | B(1.3) |
| Example 17 | Toner 17 | B | B(1.17) | C(8.82) | B(1.38) | A | C(2.5) |
| Example 18 | Toner 18 | A | B(1.18) | A(2.21) | A(1.47) | A | A(0.3) |
| Comparative Example1 | Toner 19 | C | C(1.25) | A(2.35) | D(1.24) | B | B(1.2) |
| Comparative Example 2 | Toner 20 | B | B(1.19) | D(22.59) | B(1.40) | D | D(10.5) |
| Comparative Example 3 | Toner 21 | D | D(1.40) | D(11.33) | C(1.32) | C | C(2.9) |
| Comparative Example 4 | Toner 22 | D | D(1.35) | D(30.22) | E(1.08) | D | D(15.3) |
| Comparative Example 5 | Toner 23 | D | B(1.19) | A(2.93) | E(1.10) | C | B(1.3) |
| Comparative Example 6 | Toner 24 | C | D(1.32) | A(2.08) | D(1.21) | C | B(1.4) |
| Example 19 | Toner 25 | A | A(1.13) | A(2.13) | A(1.48) | A | A(0.3) |
| Example 20 | Toner 26 | A | A(1.10) | A(2.80) | A(1.47) | A | A(0.4) |
| Example 21 | Toner 27 | A | A(1.12) | A(2.22) | A(1.45) | A | A(0.1) |
| Example 22 | Toner 28 | A | A(1.11) | A(2.38) | A(1.55) | A | A(0.2) |
| Example 23 | Toner 29 | A | A(1.13) | A(2.15) | A(1.53) | A | A(0.2) |
| Example 24 | Toner 30 | A | A(1.14) | A(2.66) | A(1.52) | A | A(0.3) |
| Example 25 | Toner 31 | A | A(1.11) | A(2.26) | A(1.50) | A | A(0.3) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-135807, filed Jun. 15, 2010 which is hereby incorporated by reference herein in its entirety.

What is claimed is:

1. A method of producing toner, the method comprising at least a colorant dispersion step of obtaining a colorant-dispersed solution by dispersing a pigment-containing colorant in a liquid mixture that contains the colorant and a dissolved resin solution or a polymerizable monomer, wherein the liquid mixture contains a nonionic surfactant, and the nonionic surfactant has at least an oxyalkylene group and has a hydrophile-lipophile balance value (HLB value) of 9.0 or more and 17.0 or less.

2. The method of producing toner according to claim 1, wherein the nonionic surfactant is a nonionic surfactant classified as a polyalkylene glycol type.

3. The method of producing toner according to claim 2, wherein the nonionic surfactant is a higher alcohol alkylene oxide adduct or a fatty acid alkylene oxide adduct.

4. The method of producing toner according to claim 2, wherein the nonionic surfactant has an oxypropylene group.

5. The method of producing toner according to claim 1, wherein the nonionic surfactant content in the liquid mixture is 0.03 mass part or more and 0.50 mass part or less per 100 mass parts of the dissolved resin solution or polymerizable monomer.

6. The method of producing toner according to claim 1, wherein the dispersion medium for dispersing the colorant is a polymerizable monomer; and, the method further comprising a polymerization step of suspending the colorant-dispersed solution obtained in the colorant dispersion step in an aqueous medium, granulating, and polymerizing the polymerizable monomer present in the granulated colorant-dispersed solution.

* * * * *